United States Patent [19]

Tominaga et al.

[11] Patent Number: 4,633,826

[45] Date of Patent: Jan. 6, 1987

[54] OVERHEAD CAM SHAFT TYPE V-ENGINE CYLINDER BLOCK

[75] Inventors: Nobuyoshi Tominaga, Hamamatsu; Nobuyoshi Kurai, Iwata; Hajime Ueno, Shizuoka; Sadahide Suzuki, Iwata, all of Japan

[73] Assignee: Yamaha Hatsudoki Kabushiki Kaisha, Iwata, Japan

[21] Appl. No.: 570,623

[22] Filed: Jan. 13, 1984

Related U.S. Application Data

[63] Continuation of Ser. No. 236,612, Feb. 20, 1981, abandoned.

[30] Foreign Application Priority Data

Feb. 21, 1980 [JP] Japan ..... 55-21017

[51] Int. Cl.[4] ..... F01L 1/04

[52] U.S. Cl. ..... 123/90.31; 123/90.27; 474/111

[58] Field of Search ..... 123/90.15, 90.17, 90.27, 123/90.31; 474/111, 136

[56] References Cited

U.S. PATENT DOCUMENTS

| | | | |
|---|---|---|---|
| 1,579,681 | 4/1926 | Weller | 474/111 |
| 2,478,106 | 8/1949 | Jozif | 123/90.31 |
| 3,388,614 | 6/1968 | De Coye de Castelet | 123/90.31 |
| 3,738,338 | 6/1973 | Wickman | 123/90.27 |
| 4,117,813 | 10/1978 | Yamashita et al. | 123/90.15 |
| 4,230,074 | 10/1980 | Ichikawa et al. | 123/90.31 |
| 4,480,603 | 11/1984 | Tsuboi | 123/90.27 |

FOREIGN PATENT DOCUMENTS

| | | | |
|---|---|---|---|
| 0001316 | 1/1977 | Japan | 474/111 |
| 1167947 | 10/1969 | United Kingdom | 123/90.31 |

*Primary Examiner*—Willis R. Wolfe, Jr.
*Attorney, Agent, or Firm*—Donald D. Mon; David O'Reilly

[57] ABSTRACT

A cylinder block construction for an overhead cam shaft type V-engine having a timing chain passage formed to allow the cylinder block to be used for diametrically opposite cylinders. Timing chain guides are positioned in the timing chain passage with one of the timing chain guides providing chain tension control. Tension control is achieved by pivotably mounting one of the chain guides and biasing the chain guide against the timing chain with a chain tension means mounted in an opening in the cylinder block. Symmetrical openings are formed on either side of the timing chained passage to receive the chain tension means. The unused opening is capped.

3 Claims, 5 Drawing Figures

OVERHEAD CAM SHAFT TYPE V-ENGINE CYLINDER BLOCK

This application is a continuation of application Ser. No. 236,612, filed Feb. 20, 1981, now abandoned.

FIELD OF THE INVENTION

The present invention relates to an improved cylinder block for an overhead cam shaft type V-engine.

BACKGROUND OF THE INVENTION

In a V-type engine, in which an overhead cam shaft is driven by means of a timing chain, the cylinder block has to be formed with a chain passage through which the timing chain is allowed to pass. At the tensile and slack sides of the chain, arranged in a sliding manner, are two chain guides. The chain guide at the slack side is elastically urged toward the chain by a chain tensioner in order to apply a predetermined tension to the chain. Therefore, the chain passage has to be formed with a larger space outside of the slack side than the space outside of the tensile side of the chain. On the other hand, there is a case in which the timing chain is arranged at that side of one of the V-shaped cylinders, which is different from the side of the other cylinder, such that it is directed at a right angle with respect to a crankshaft. In the so-called "tandem V-engine" having its respective cylinders inclined in the longitudinal direction, for example, timing chains are sometimes arranged at the righthand side of one cylinder and at the lefthand side of the other cylinder, respectively. In the so-called "transverse V-engine" having its respective cylinders inclined in the transverse direction, on the contrary, timing chains are sometimes arranged at the front side of one cylinder and at the rear side of the other cylinder, respectively.

In such engines, if the slack side of the timing chain of one cylinder is positioned in the V-shaped space of two cylinders, the slack side of the timing chain of the other cylinder is positioned at the outer side which is opposite to the side facing that space. In other words, the tensile side of one cylinder and the slack side of the other cylinder are positioned at the sides facing that space. As a result, the conventional cylinder block, in which the larger space is formed only outside of the slack side of each timing chain, has to be formed into a different shape for each cylinder so that a completely different mold has to be prepared because of a slight difference in the shapes. Moreover, the number of different parts is so increased that their management becomes troublesome.

BRIEF DESCRIPTION OF THE INVENTION

The present invention has been conceived in view of the background thus far described and contemplates to provide a cylinder block for an overhead cam shaft type V-engine, in which the cylinder blocks of the respective cylinders forming a shape of letter "V" are made common so that the number of parts can be reduced.

In order to attain that comtemplation, according to the present invention, the chain passage, through which a timing chain is allowed to pass, is formed with substantially the same spaces at both the tensile and slack sides of the aforementioned timing chain. The above and other features of the present invention will be more fully understood from the following detailed description and with reference to the accompanying drawings.

BRIEF DESCRIPTION OF THE INVENTION

DETAILED DESCRIPTION OF THE INVENTION

Figure 1:
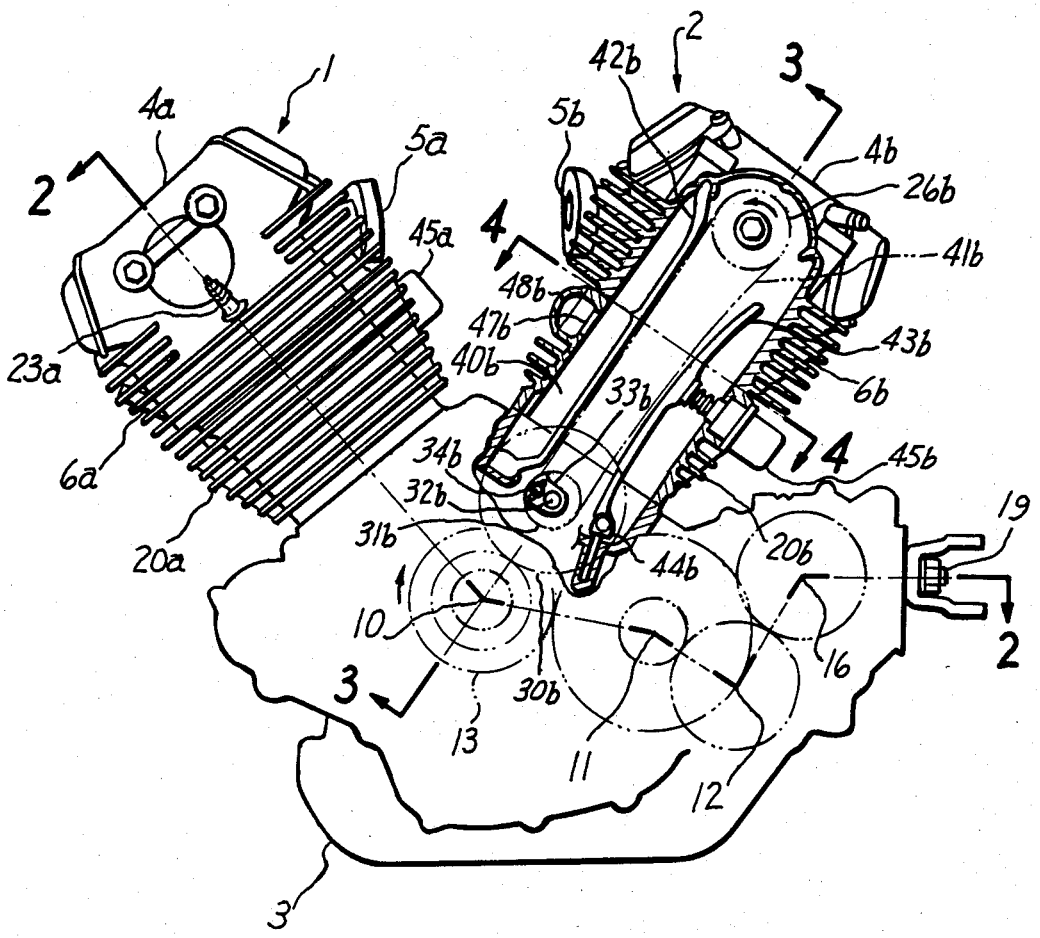
FIG. 1 is a side elevation in partial section showing an overhead cam shaft type V-engine for a motorcycle according to the present invention.
Figure 2:
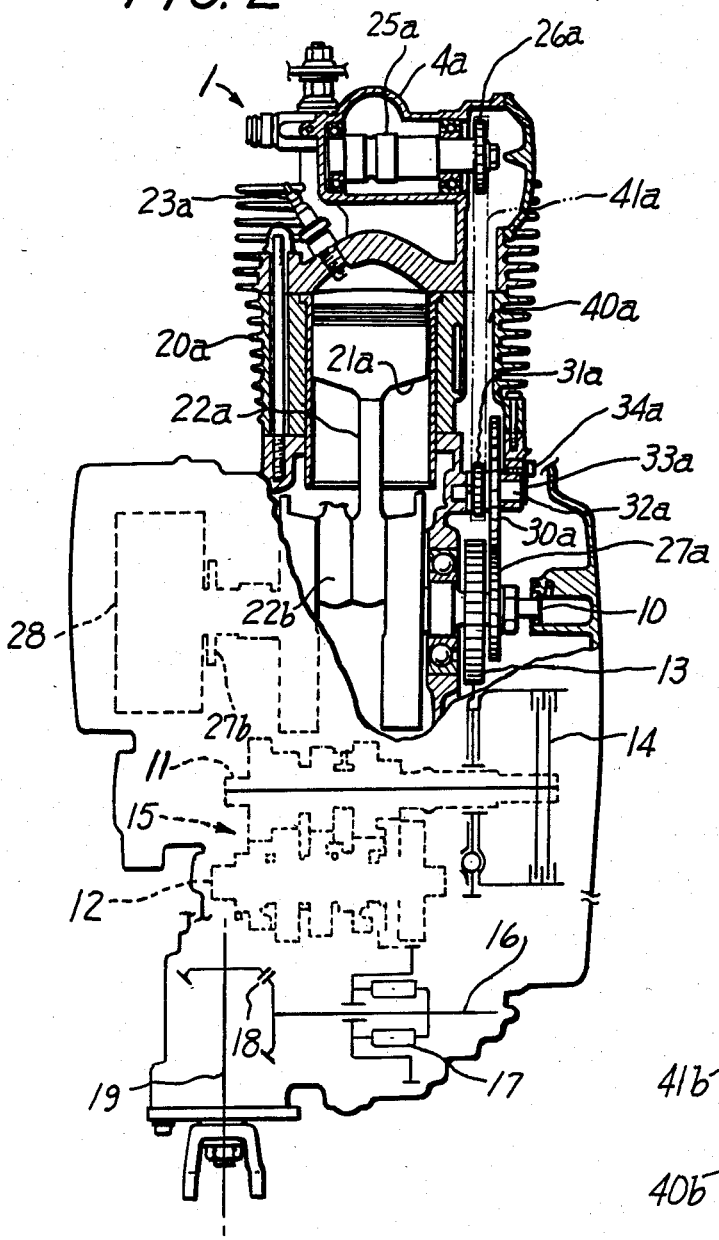
FIGS. 2 and 3 are sectional views taken along lines II—II and III—III of FIG. 1 respectively.
Figure 3:
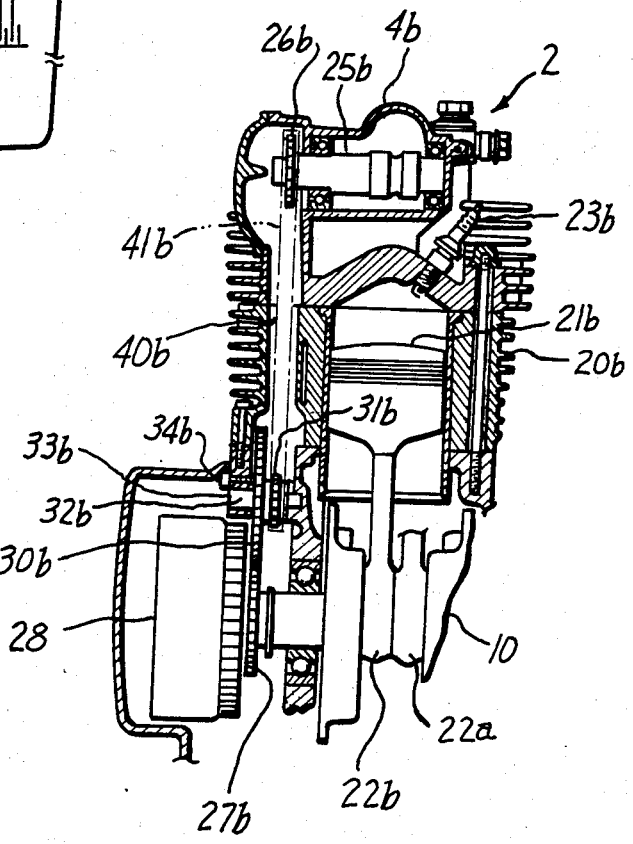
Figure 4:
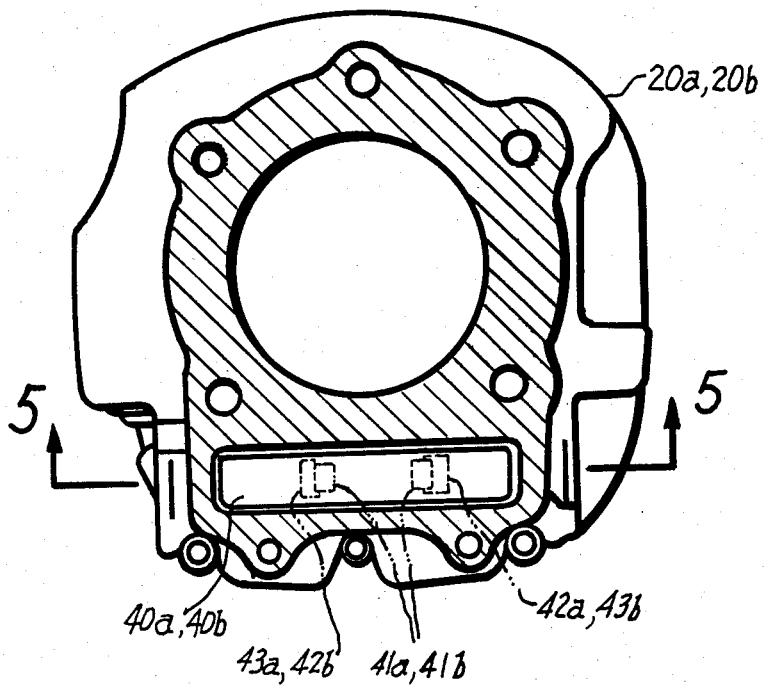
FIG. 4 is a sectional view showing a cylinder block taken along line IV—IV of FIG. 1.

In FIGS. 1 to 4, reference numerals 1 and 2 indicate a front cylinder and a rear cylinder, respectively, both of which are symmetrically mounted on crankcase 3. In FIG. 1, more specifically, the respective cylinders have cylinder heads 4*a* and 4*b* formed in adjacent sides with intake ports 5*a* and 5*b*, respectively, and in opposite sides with exhaust ports 6*a* and 6*b*, respectively. In the embodiment being described, cylinder blocks 20*a* and 20*b* described hereinafter and cylinder heads 4*a* and 4*b* are common between the front and rear cylinders 1 and 2.

Numeral 10 indicates a crankshaft, while numerals 11 and 12 indicate main and auxiliary shafts which form a part of a reduction gear mechanism. The rotation of the crankshaft 10 is transmitted to main shaft 11 through gear 13, keyed to crankshaft 10, and a clutch 14 mounted on main shaft 11. The rotation of main shaft 11 transmitted is further transmitted through reduction gear train 15 to auxiliary shaft 12, the rotation of which are further transmitted through damper 17 to damper shaft 16. The rotations of the damper shaft 16 are further transmitted through bevel gear 18 to output shaft 19. The output shaft 19 protrudes backwardly from the crankcase so that its rotations are transmitted to a rear wheel through a not-shown propeller shaft (not shown) connected to the protruding end thereof.

Numerals 20*a* and 20*b* indicates identical cylinder blocks of front and rear cylinders 1 and 2, respectively. Numerals 21*a* and 21*b* indicate pistons which are made reciprocally movable up and down within cylinder blocks 20*a* and 20*b*, respectively. Numerals 22*a* and 22*b* indicate connecting rods connecting pistons 21*a* and 21*b* and the aforementioned crankshaft 10. Incidentally, numerals 23*a* and 23*b* indicate ignition plugs.

Numerals 25*a* and 25*b* indicate overhead cam shafts positioned in cylinder heads 4*a* and 4*b*, respectively, so that intake and exhaust valves openings are controlled by rotation of cam shafts 25*a* and 25*b*. Cam shaft 25*a* of front cylinder 1 has sprocket 26*a* fixed thereto at the righthand side, as viewed forward (i.e., at the lefthand side of FIG. 1) of the engine, whereas cam shaft 25*b* of rear cylinder 2 has sprocket 26*b* fixed thereto at the lefthand side, as viewed forward of the engine.

Drive gear 27*a* for driving cam shaft 25*a* of the front cylinder 1 is secured in the vicinity of the righthand end portion of crankshaft 10, whereas drive gear 27*b* for driving cam shaft 25*b* of rear cylinder 2 is secured in the vicinity of the lefthand end portion. A dynamotor 30 is attached to the lefthand end portion of crankshaft 10.

Numerals 30*a* and 31*a* indicate outer gear and inner sprocket respectively, integrally made, which are made integral and rotatably born on intermediate shaft 32*a* arranged on a line joining crankshaft 10 and cam shaft 25*a* of front cylinder 1. Intermediate shaft 32*a* is eccentric at the portion, on which gear 30*a* and sprocket 31*a* are born, and has adjusting plate 33*a* attached to the axial end. Gear 30*a* is held in meshing engagement with gear 27*a*, made integral with crankshaft 10, so that the spacing between gear 30*a* and gear 27*a* is changed if intermediate shaft 32*a* is rotated. As a result, adjusting plate 33*a* is used to determine the rotational position of intermediate shaft 32*a*, and for this purpose bolt 34*a* engages an arcuate slot formed in adjusting plate 33*a*. More specifically, adjusting plate 33*a* and intermediate shaft 32*a* are made rotatable by loosening bolt 34*a* or are fixed by fastening bolt 34*a*. For the rear cylinder 2, gear 30*b*, sprocket 31*b*, intermediate shaft 32*b*, adjusting plate 33*b* and bolt 34*b* are identical in construction to corresponding parts of front cylinder 1.

Numerals 40*a* and 40*b* indicate chain passages, of which chain passage 40*a* is formed at the righthand side of front cylinder 1 whereas chain passage 40*b* is formed at the lefthand side of rear cylinder 2. Timing chain 41*a* runs on gears 26*a* and 31*a* through chain passage 40*a*, whereas timing chain 41*b* runs on gears 26*b* and 31*b* through chain passage 40*b*. Specifically, respective timing chains 41*a* and 41*b* are arranged at the right and left different sides of respective cylinders 1 and 2 such that they are directed at right angles with respect to the crankshaft 10.

Numeral 42*b* indicates a chain guide which is in sliding contact with the tensile side of timing chain 41*b*, as shown in FIG. 1, and which has its lower and upper ends retained in crankcase 3 and cylinder head 4*b*, respectively. On the other hand, numeral 43*b* indicates a chain guide in sliding contact with the slack side of timing chain 41*b* and which has its lower end portion rockably held by holding member 44*b* which in turn is fixedly inserted in crankcase 3. Chain guide 43*b* is elastically urged toward chain 41*b* by the action of chain tensioner 45*b* attached to cylinder block 20*b*. For the front cylinder 1, chain guide and the holding member are identical in construction to corresponding parts of rear cylinder 1.

Figure 5:
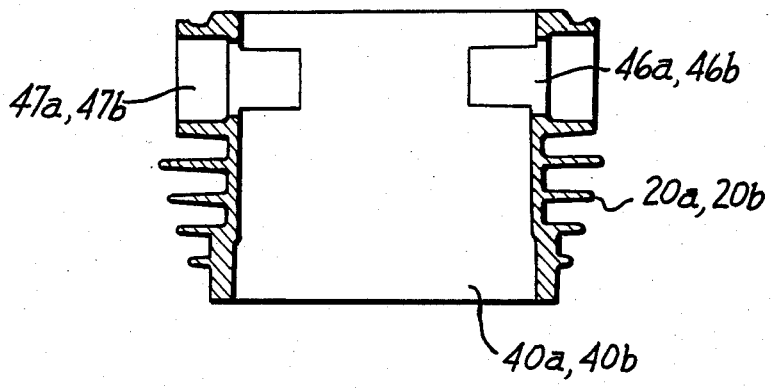
FIG. 5 is a sectional view taken along line V—V of FIG. 4.

Chain passages 40*a* and 40*b* formed in cylinder blocks 20*a* and 20*b* are formed with substantially the same sufficient spacings at the longitudinally front and rear sides of timing chains 42*a* and 42*b*, and 43*a* and 43*b*. The front and rear walls of chain passages 40*a* and 40*b* are symmetrically formed with openings 46*a* and 46*b*, and 47*a* and 47*b*, respectively. Chain tensioner 45*b* of rear cylinder 2, shown in FIG. 1, is fixed in righthand opening 46*b* of cylinder block 20*b* shown in FIG. 5, whereas cap 48*b* covers the other opening 47*b*. In front cylinder 1, on the other hand, chain tensioner 45*a* is fixed in the lefthand opening 47*a* of FIG. 5, whereas a cap (not shown) covers the other opening 46*a*.

Although, in the embodiment thus far described, the respective cylinders are arranged in the longitudinal direction, the present invention can naturally be applied to an engine of the type having the respective cylinders arranged in the transverse direction.

According to the embodiment described, moreover, since not only the cylinder blocks 20*a* and 20*b* but also the cylinder heads 4*a* and 4*b* are made common, the production efficiency of the engine can be greater than that obtainable when only the cylinder blocks are made common.

As has been described hereinbefore, according to the present invention, since the chain passage is simultaneously formed with the same spaces outside of both the tensile and slack sides of the timing chain, it can accommodate the chain guides and the chain tensioner even when the timing chain positions are reversed. As a result, it becomes possible to use the same cylinder blocks for the respective cylinders. If the cylinder blocks are to be cast, both production efficiency, supply and management are improved as only one mold is needed.

The invention is not to be limited to the embodiment shown in the drawings and described in the description, which is given by way of example and not of limitation but only in accordance with the scope of the appended claims.

What is claimed is:

1. In an overhead camshaft type V-engine having V-shaped cylinders equipped with an overhead camshaft drive by a timing chain disposed and arranged on either side of said cylinders at a right angle to a crankshaft, the improvement comprising:

a cylinder block;

a timing chain passage in said cylinder block, said passage housing said timing chain for chain movement in a plane of said chain, said passage including a spacing on each side of a pair of runs of said chain, and in said plane, said spacing on each side of a pair of runs of said chain being substantially the same;

said block further including a wall at least partially bounding said spacings and intersecting said plane, said wall having symmetrical wall openings therethrough symmetrically disposed on opposite sides of said chain and its plane, and opening into a respective substantially same spacing;

a plurality of chain guide means, each mounted in a respective substantially same spacing; and tensioning means resiliently biasing one of said chain guide means toward and against a run of said chain to place the chain in tension, at least a portion of said tensioning means being mounted in one of said symmetrical wall openings adjacent to the respective run, the symmetry of said symmetrical wall openings enabling said tensioning means to be positioned adjacent to either run, whereby said cylinder block may be used for diametrically opposite cylinders.

2. Apparatus according to claim 1 in which said one chain guide means is pivotally mounted at one end of said timing chain passage; said chain tensioning means being entirely mounted in one of said symmetrical wall openings and supported by said wall, the other of said symmetrical wall openings being capped.

3. Apparatus according to claim 1 in which said one chain guide means is pivotally mounted at one end of said timing chain passage; said chain tensioning means being mounted in one of said symmetrical wall openings and arranged to bias said one chain guide means against said timing chain to adjust the tension, the other of said symmetrical openings being capped.

* * * * *